US010738465B2

(12) United States Patent
Alnakkar

(10) Patent No.: US 10,738,465 B2
(45) Date of Patent: Aug. 11, 2020

(54) SUSPENDED BAFFLE SYSTEM

(71) Applicant: USG Interiors, LLC, Chicago, IL (US)

(72) Inventor: Faris Alnakkar, Oakville (CA)

(73) Assignee: USG INTERIORS, LLC, Chicago, IL (US)

( * ) Notice: Subject to any disclaimer, the term of this patent is extended or adjusted under 35 U.S.C. 154(b) by 246 days.

(21) Appl. No.: 15/498,563

(22) Filed: Apr. 27, 2017

(65) Prior Publication Data

US 2018/0313081 A1 Nov. 1, 2018

(51) Int. Cl.

| | |
|---|---|
| ***E04B 9/26*** | (2006.01) |
| ***E04B 9/28*** | (2006.01) |
| ***E04B 1/99*** | (2006.01) |
| ***E04B 1/82*** | (2006.01) |
| ***E04B 9/06*** | (2006.01) |
| ***E04B 9/36*** | (2006.01) |
| *E04B 9/22* | (2006.01) |
| *G10K 11/16* | (2006.01) |

(52) U.S. Cl.

CPC ..... *E04B 1/99* (2013.01); *E04B 9/068* (2013.01); *E04B 9/26* (2013.01); *E04B 9/366* (2013.01)

(58) Field of Classification Search

CPC . G10K 11/175; E04B 1/82; E04B 1/99; E04B 9/008; E04B 9/0435; E04B 9/06; E04B 9/22; E04B 9/24; E04B 9/242; E04B 9/26; E04B 9/28; E04B 2001/8263; E04B 2001/829

See application file for complete search history.

(56) References Cited

U.S. PATENT DOCUMENTS

| | | | | | |
|---|---|---|---|---|---|
| 1,998,423 | A * | 4/1935 | Stubbs | E04B 9/26 | 52/145 |
| 2,160,638 | A * | 5/1939 | Bedell | E04B 9/34 | 181/30 |
| 2,752,017 | A * | 6/1956 | Segil | E04B 9/30 | 52/506.06 |
| 2,759,093 | A * | 8/1956 | Sundberg | F21V 7/0016 | 362/234 |
| 3,082,487 | A * | 3/1963 | Fowler | E04B 9/0478 | 52/145 |
| 3,277,622 | A * | 10/1966 | Jensen | E04B 9/363 | 52/222 |
| 3,390,495 | A * | 7/1968 | Dalby | E04F 13/0812 | 52/222 |
| 3,550,341 | A * | 12/1970 | Thompson | E04B 9/0485 | 52/506.09 |
| 3,934,387 | A * | 1/1976 | Moeller | E04B 9/003 | 52/506.07 |

(Continued)

*Primary Examiner* — Edgardo San Martin

(74) *Attorney, Agent, or Firm* — Pearne & Gordon LLP

(57) ABSTRACT

An acoustical baffle system for suspension in an open plenum space comprising a plurality of parallel spaced carriers and a plurality of parallel spaced baffles suspended on and transverse to the carriers, the carriers having pairs of opposed, uniformly spaced grips on their lower faces, pairs of opposed grips being spaced along the carrier at a regular center-to-center distance greater than the spacing between a pair of opposed grips, the baffles having a relatively deep U-shaped cross-section with sides and a bottom between the sides, outwardly directed flanges at upper ends of the sides, the flanges being received in a respective pair of grips on each of a plurality of carriers.

4 Claims, 3 Drawing Sheets

(56) References Cited

U.S. PATENT DOCUMENTS 4,033,083 A * 7/1977 Fritz ..... E04B 9/24 52/357
4,245,442 A * 1/1981 Durham ..... E04B 2/7455 52/126.4
4,309,858 A * 1/1982 Anderle ..... E04B 9/36 52/506.08
4,328,653 A * 5/1982 Anderle ..... E04B 9/363 52/460
4,432,182 A * 2/1984 Addie ..... E04B 9/26 52/480
4,438,613 A * 3/1984 Hintsa ..... E04B 9/003 49/465
4,463,537 A * 8/1984 Rodriquez ..... E04B 9/225 52/506.07
4,480,360 A * 11/1984 Brugman ..... E04B 9/26 24/295
4,580,382 A * 4/1986 Judkins ..... E04B 9/26 52/506.08
4,646,506 A * 3/1987 Slapsys ..... E04B 9/363 52/460
4,696,142 A * 9/1987 Mieyal ..... E04B 9/26 52/506.08
4,760,677 A * 8/1988 Nassof ..... E04B 9/28 52/145
4,913,261 A * 4/1990 Scheinberg ..... E04B 1/8404 181/287
5,035,298 A * 7/1991 Noxon ..... E04B 1/8209 181/295
5,115,611 A * 5/1992 Lim ..... E04B 9/36 52/222
5,115,616 A * 5/1992 Nixon ..... E04B 9/001 52/144
5,293,728 A * 3/1994 Christopher ..... F16B 5/0016 52/309.9
5,428,930 A * 7/1995 Bagley ..... E04B 9/003 52/483.1
5,623,130 A * 4/1997 Noxon ..... E04B 1/8209 181/30
6,336,302 B1 * 1/2002 Brugman ..... E04B 9/26 52/483.1
6,513,295 B2 * 2/2003 Bernardino ..... E04B 9/001 52/407.4
6,672,025 B1 * 1/2004 Yuan ..... B21D 35/00 52/245
8,056,294 B2 * 11/2011 LaLonde ..... E04B 9/06 52/506.08
8,695,296 B2 * 4/2014 Bergman ..... E04B 9/366 52/243.1
8,857,121 B2 * 10/2014 Baxter ..... E04B 9/363 52/506.08
2004/0148894 A1 * 8/2004 Kelley ..... E04B 9/003 52/506.01
2006/0005495 A1 * 1/2006 Stessel ..... E04B 9/003 52/506.07
2009/0151134 A1 * 6/2009 Neuhofer, Jr. ..... E04F 19/0436 24/292

* cited by examiner

FIG. 2
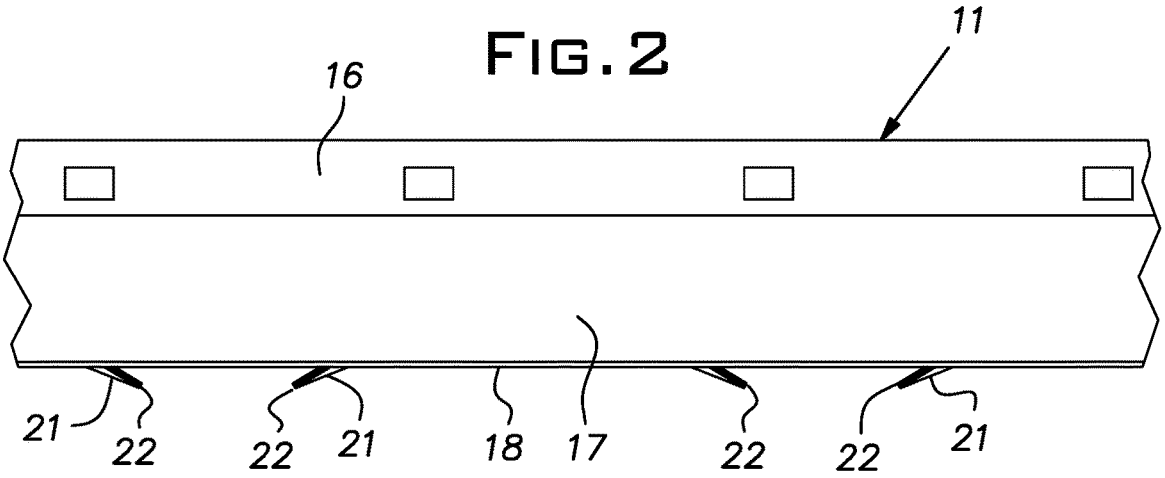
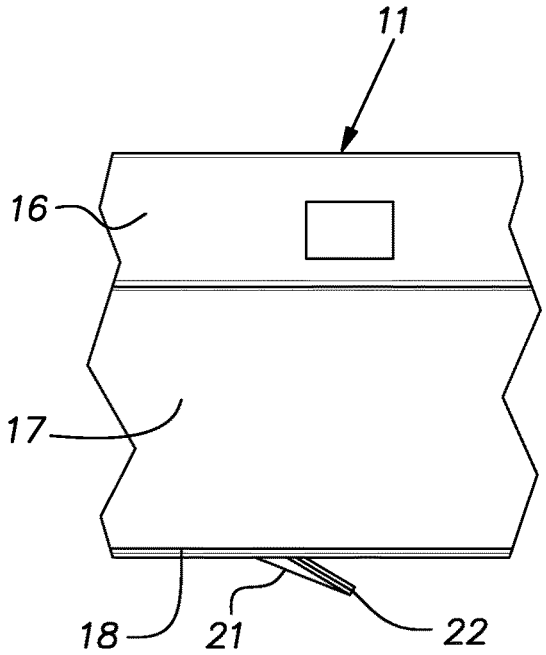
FIG. 3
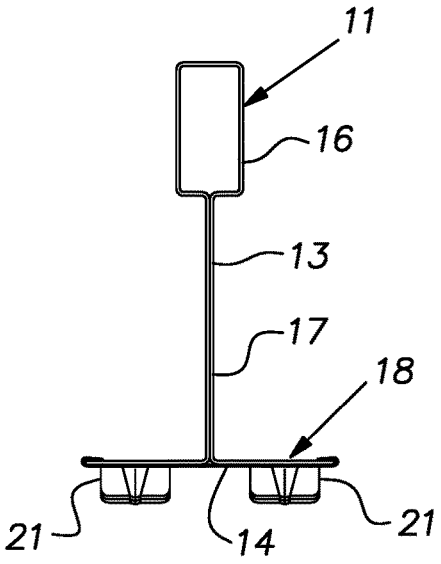
FIG. 4

SUSPENDED BAFFLE SYSTEM

BACKGROUND OF THE INVENTION

The invention provides a suspended baffle system useful in open plenum building spaces.

PRIOR ART

Suspended baffles above occupied spaces are increasingly being used for sound control and to improve aesthetics. Prior baffle systems have often been custom designed with new components, requiring new tooling, supplies, and increased inventory. New construction and assembly techniques can have the added disadvantage of being unfamiliar to contractors and installers. This unfamiliarity may be a source of resistance to acceptance in the trade and may involve increased labor costs.

Various linear metal ceiling systems have been available in the industry and are familiar to those working in the trade.

SUMMARY OF THE INVENTION

The invention provides a suspended baffle system that utilizes existing linear ceiling technology and componentry and which achieves both sound control and an attractive appearance. The disclosed system employs hollow sheet metal baffles that are arranged to snap into opposed grips formed on elongated carriers of known design. The deep sections of the baffles greatly rigidifies the carrier grid both as a beam section and as a torsion element between adjacent carriers. The baffles are constructed with a unique mounting flange structure that is resistant to damage during shipping, handling and installation, and is self-aligning to the carrier grip elements. Sheet metal clips, previously used in linear ceiling construction can be used to secure the baffles in place on the carriers. The clips are installed completely within the baffles so that they are hidden from view and cannot distract from the appearance of the system.

BRIEF DESCRIPTION OF THE DRAWINGS

FIG. 2 is a fragmentary elevational view of a carrier of the system;

FIG. 3 is an enlarged view of a portion of the carrier;

FIG. 4 is a cross-sectional view of the carrier;

DESCRIPTION OF THE PREFERRED EMBODIMENT

Figure 1:
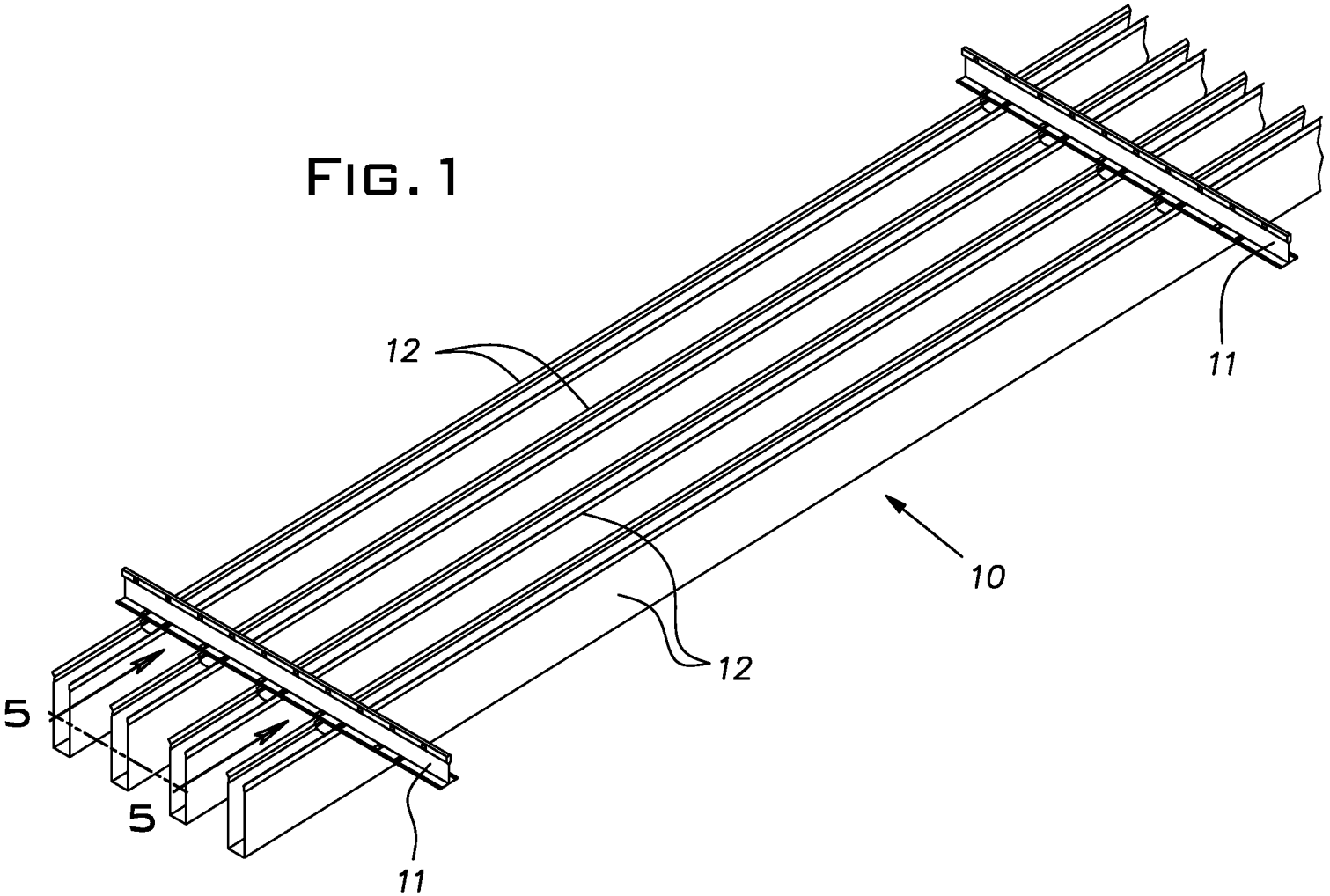
FIG. 1 is a fragmentary perspective view, from above, illustrating a suspended acoustical baffle system embodying the invention.
Figure 5:
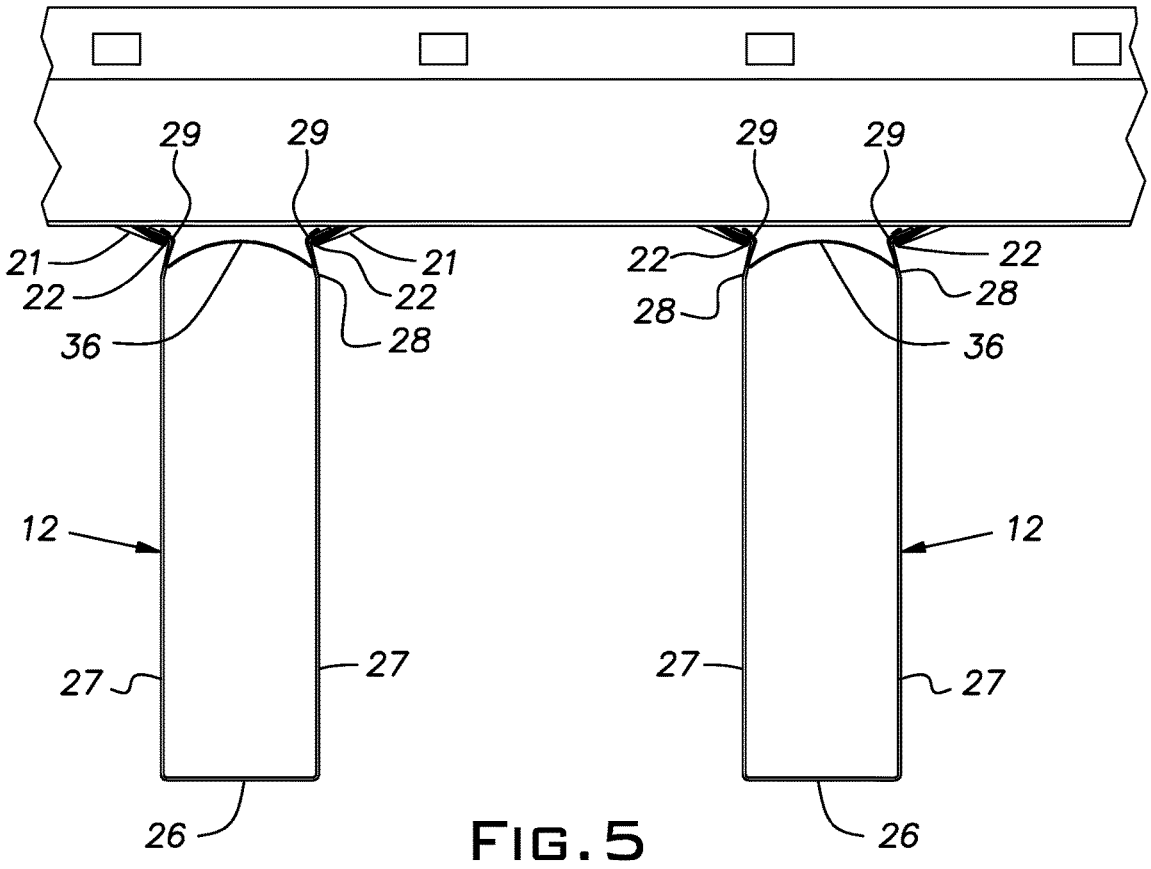
FIG. 5 is a cross-sectional view of the system taken across the plane 5-5 indicated in FIG. 1.

An acoustical baffle system 10 is formed of a suspended rectangular grid of carriers 11 and baffles 12. The carriers 11 are arranged in spaced parallel relation and the baffles 12 are mounted transversely on the carriers in spaced parallel relation. The carriers 11, detailed in FIGS. 2-4, are generally known in the art and can be suspended from overhead structure by wires, for example, in a conventional manner. The illustrated carrier 11 is a roll-formed sheet metal assembly of a main body strip 13 and a lower face strip 14. The carrier 11 has a symmetrical tee shape cross-section including an upper hollow reinforcing bulb 16, a vertical web 17 and a horizontal flange 18.

The flange 18 is lanced on both sides of the web 17 to form local grips 21 diverging downwardly from a plane of the flange at an acute angle of, for example, 30 degrees. The illustrated grips 21 are provided in opposed pairs where their open free ends 22 are spaced nominally one inch apart. The pairs of grips 21 are spaced from adjacent pairs on nominal four inch centers. Typically, the carriers 11 are supplied in 10 foot lengths with end connectors enabling them to be joined to cover any desired expanse. Cross tees, not shown, of nominal 2 foot or 4 foot lengths can be assembled between adjacent carriers 11 to accurately space and align the carriers. When installed, the carriers 11 of the grid are in mutual alignment so that the pairs of grips 21 of adjacent carriers each lie along a line perpendicular to the carriers.

Baffles 12 have a deep U-shape of rectangular cross-section and can be provided in 10 foot or 12 foot lengths, for example. The baffles 12 can be formed of a suitable sheet metal such as 0.020 inch hot dipped galvanized (HDG) steel or 0.032 inch aluminum.

The illustrated baffles 12 have a lower side or face 26 with a width of nominally 1⅛ inch and sides 27 in a height ranging, for example, between 3½ inches to 6 inches. Upper edges of both sides 27 are characterized by inward and outward bends 28, 29 that produce a narrowing of the baffle width at the second or upper bend 29. Marginal or distal portions 30 of the baffle sides 27 outward of the second bend 29 take the shape of flanges with an acute angular orientation from the horizontal of, for example, about 24 degrees so that their distal edges engage the upper sides of the grips 21.

Figure 6:
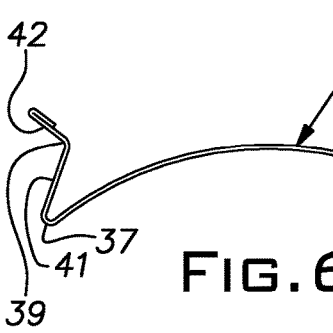
FIG. 6 is an end view of a baffle retention clip.
Figure 7:
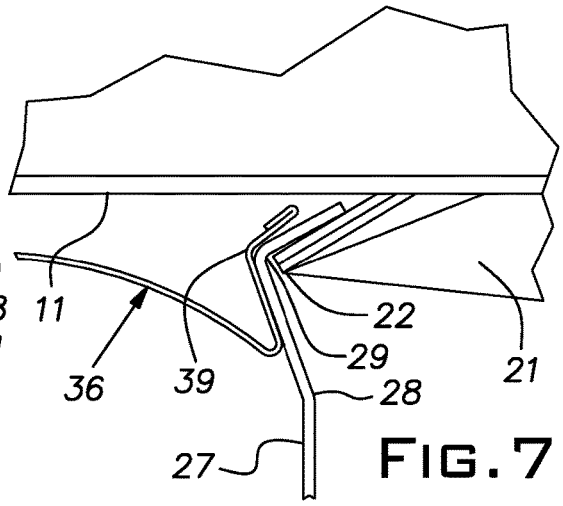
FIG. 7 is an enlarged fragmentary view of one side of a retention clip engaging an upper margin of a baffle side assembled on a carrier grip.

The baffles 12 have sufficient resilience to allow upper ends of the sides 27 to be deflected and snapped in-between a pair of opposed grips 21. The double bend geometry makes the baffle 12 vertically self-aligning to the grips; the spring-back character of the baffle causes upper marginal side portions to slide over the grips until free ends 22 of the grips abut the second bend 29 where the width of the baffle 12 is narrowest. A baffle 12 can be retained in place on a carrier with a clip 36 illustrated in an end view in FIG. 6. The clip 36, for example, is formed of hardened aluminum sheet stock of 0.010 inch gauge and can be 1 1/16 inches wide between corners 37 and 2 inches long. Sides 38 of the clip 36 are bent into an obtuse angle forming a corner 39 between sections 41, 42. With a baffle 12 first installed on a pair of opposed grips 21 of a carrier 11, the clip 36 can be snapped into the baffle at a location adjacent the carrier. The clip corners 39 will automatically register with the upper bends 29 of the baffle 12. The clip 36 can be pushed under the carrier 11 between the opposed grips 21. During this motion, the clip is conveniently guided on the interior baffle surfaces adjoining the upper bends 29.

To enhance the sound control afforded by the baffles 12, the baffles can be perforated through their exposed surfaces. Additionally, the interior of a baffle 12 can be lined with an acoustical nonwoven fabric, known in the art, and/or can be completely or partially filled with fiberglass, mineral wool or other sound absorbing material. The exterior of the carrier 11 can be painted black to minimize its appearance.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An acoustical baffle system for suspension in an open plenum space comprising a plurality of elongated parallel spaced carriers and a plurality of parallel spaced baffles suspended on and transverse to the carriers, the carriers each having a plurality of pairs of opposed, inwardly directed, uniformly spaced grips on their lower faces, the grips diverging downwardly from planes of the lower faces of the carriers, pairs of opposed grips being spaced along the carrier at a regular center-to-center distance greater than the spacing between a pair of opposed grips, the baffles having a relatively deep U-shaped cross-section with a depth exceeding a width and with sides and a bottom between lower ends of the sides, outwardly directed flanges at upper ends of the sides extending outward of and beyond the planes of the sides when installed and having an upwardly inclined orientation corresponding to the downwardly diverging configuration of the grips, the flanges being entirely below the carriers apart from the grips and received in a respective pair of grips on each of a plurality of carriers, a spring back character of the baffle causing free ends of the grips to abut a narrow portion of the baffle, the upper ends of the sides including double bends, upper ones of said bends forming a narrowest part of the baffle adjacent its upper end.

2. An acoustical baffle system as set forth in claim 1, wherein the flanges are locked in the respective grips of a carrier by a clip disposed in a baffle and bridging a space between the flanges.

3. An acoustical baffle system as set forth in claim 1, wherein said grips have free ends engaging the upper one of said bends.

4. An acoustical baffle system as set forth in claim 1, wherein said clip includes corners constructed and arranged to align the clip with said upper bends.

* * * * *